US012426726B2

(12) United States Patent
McGill

(10) Patent No.: US 12,426,726 B2
(45) Date of Patent: Sep. 30, 2025

(54) DIVIDED SHELF FOR MODULAR GREETING CARD RACK

(71) Applicant: VANGUARD PACKAGING, LLC, Kansas City, MO (US)

(72) Inventor: Apryl McGill, Kansas City, MO (US)

(73) Assignee: VANGUARD PACKAGING, LLC, Kansas City, MO (US)

( * ) Notice: Subject to any disclaimer, the term of this patent is extended or adjusted under 35 U.S.C. 154(b) by 0 days.

(21) Appl. No.: 18/822,822

(22) Filed: Sep. 3, 2024

(65) Prior Publication Data

US 2025/0024967 A1 Jan. 23, 2025

Related U.S. Application Data

(60) Division of application No. 18/114,579, filed on Feb. 27, 2023, now Pat. No. 12,075,928, which is a continuation of application No. 16/896,503, filed on Jun. 9, 2020, now Pat. No. 11,589,689.

(60) Provisional application No. 62/859,570, filed on Jun. 10, 2019.

(51) Int. Cl.
*A47F 5/11* (2006.01)
*A47F 5/00* (2006.01)

(52) U.S. Cl.
CPC ..... *A47F 5/116* (2013.01); *A47F 5/005* (2013.01)

(58) Field of Classification Search
CPC ..... A47F 5/116; A47F 5/005; A47F 5/112; A47F 5/10; A47F 5/101; A47F 5/11; A47F 5/114; A47F 5/0018; A47F 5/0025; A47F 7/0028; A47F 7/144; A47F 5/132; A47F 5/108; A47F 7/145; A47B 43/02; A47B 47/06; A47B 55/06; A47B 43/00
See application file for complete search history.

(56) References Cited

U.S. PATENT DOCUMENTS 235,381 A * 12/1880 Rohlfs ..... G10D 1/10 84/269
2,062,165 A * 11/1936 Davidson ..... A47F 5/112 211/135
2,578,060 A * 12/1951 Grant ..... B65D 5/324 229/122.34
2,883,098 A * 4/1959 Horner ..... B65D 5/48002 229/120.13
2,918,178 A * 12/1959 Leone ..... A47F 5/116 211/195

(Continued)

FOREIGN PATENT DOCUMENTS

DE 3824930 A1 1/1990
GB 1188834 A 4/1970

OTHER PUBLICATIONS

"Ex Parte Quayle Action Received For U.S. Appl. No. 16/896,503, mailed on Sep. 8, 2022."

(Continued)

*Primary Examiner* — Devin K Barnett
(74) *Attorney, Agent, or Firm* — Kutak Rock LLP

(57) ABSTRACT

A divided shelf for a display rack and related methods are provided. The divided shelf transforms from a knockdown configuration to an erected configuration. The divided shelf includes divider panels to divide the shelf into more than one separate compartments. The divided shelf is affixed to a display rack base.

6 Claims, 6 Drawing Sheets

(56) References Cited

U.S. PATENT DOCUMENTS 3,139,192 A * 6/1964 Maguire ..... G09F 5/00 D6/683.1
3,195,798 A * 7/1965 Wilson ..... B65D 5/02 229/102
3,362,610 A * 1/1968 Van Dyke ..... B65D 5/4804 229/122
3,987,737 A * 10/1976 Smith ..... A47F 5/116 108/179
4,228,904 A * 10/1980 Dumond ..... A47F 5/112 211/73
4,341,338 A * 7/1982 Arnold ..... B65D 5/443 229/199
4,383,636 A * 5/1983 Chaffers ..... B65D 5/321 206/509
4,427,108 A * 1/1984 Coles ..... B65D 5/001 229/125.32
4,458,838 A * 7/1984 Lacasa ..... B65D 5/6664 229/199
4,506,790 A * 3/1985 Muscari ..... A47F 5/116 211/59.4
4,519,319 A * 5/1985 Howlett ..... A47F 5/116 108/180
4,567,996 A * 2/1986 Muise ..... B65D 5/005 229/125.17
4,646,922 A * 3/1987 Smith ..... A47F 5/116 211/186
4,871,067 A * 10/1989 Valenti ..... B65D 5/54 206/427
5,016,545 A * 5/1991 Robertson ..... A47F 7/281 108/179
5,145,244 A * 9/1992 Kersting ..... A47B 43/02 312/259
5,190,211 A * 3/1993 Stoddard ..... A47F 5/116 229/120.21
5,193,466 A * 3/1993 Eder ..... A47F 5/116 108/166
5,213,220 A * 5/1993 McBride ..... A47B 55/06 211/132.1
5,253,769 A * 10/1993 Vlastakis ..... A47F 5/112 211/126.16
5,277,360 A * 1/1994 DeMott ..... B65D 5/16 229/164
5,301,800 A * 4/1994 Kenney ..... A47F 7/147 206/45.25
5,315,936 A * 5/1994 Smith ..... A47F 5/116 108/165
5,316,210 A * 5/1994 Scullin ..... B65D 5/48048 229/172
5,333,777 A * 8/1994 Roth ..... B65D 5/323 229/164
5,702,011 A * 12/1997 Carroll ..... A47F 5/04 211/186
5,706,959 A * 1/1998 Smith ..... A47F 5/0018 108/165
5,775,573 A * 7/1998 Smith ..... A47F 5/112 206/757
5,826,732 A * 10/1998 Ragsdale ..... A47F 5/116 108/165
5,966,857 A * 10/1999 Pettersson ..... G09F 1/065 40/606.12
6,068,140 A * 5/2000 Mangrum ..... A47F 5/116 108/165
6,098,820 A * 8/2000 Smith ..... A47F 5/116 211/132.1
6,126,254 A * 10/2000 Maglione ..... A47F 5/116 312/259
6,347,772 B1 * 2/2002 L'Hotel ..... G09F 1/065 206/45.24
6,378,710 B1 * 4/2002 Grueneberg ..... A47F 5/116 211/72
6,457,421 B1 * 10/2002 Apichom ..... B60N 3/005 108/44
6,508,023 B2 * 1/2003 Moss ..... G09F 1/065 40/787
6,612,669 B2 * 9/2003 Grueneberg ..... A47B 43/02 108/165
6,715,623 B2 * 4/2004 Broerman ..... A47F 5/116 211/149
7,007,615 B2 * 3/2006 Grueneberg ..... A47F 5/116 108/165
7,066,342 B2 * 6/2006 Baechle ..... B65D 21/0215 206/600
7,111,735 B2 * 9/2006 Lowry ..... B65D 5/52 206/766
7,137,517 B2 * 11/2006 Lowry ..... B65D 21/0215 229/199
7,252,200 B1 * 8/2007 Hester ..... A47F 5/116 211/187
7,281,648 B2 * 10/2007 Lowry ..... B65D 13/04 229/199
7,546,927 B2 * 6/2009 Lowry ..... A47F 3/142 206/557
7,634,865 B2 * 12/2009 L'Hotel ..... G09F 1/06 40/539
7,753,218 B2 * 7/2010 Moss ..... A47F 5/116 211/149
8,376,213 B2 * 2/2013 Brand ..... B65D 71/16 206/427
8,596,518 B2 * 12/2013 Babcock ..... B65D 5/443 229/199
9,212,019 B2 * 12/2015 Frost ..... A47F 7/147
9,578,978 B2 2/2017 Frost
9,986,856 B1 6/2018 Frost
10,390,634 B2 8/2019 Frost
11,589,689 B2 * 2/2023 McGill ..... A47F 5/005
12,075,928 B2 9/2024 Mcgill
2002/0108541 A1 * 8/2002 Grueneberg ..... A47F 5/116 312/258
2003/0160015 A1 * 8/2003 Broerman ..... A47F 5/116 211/132.1
2005/0067321 A1 * 3/2005 Pitts ..... A47F 5/116 206/774
2006/0213851 A1 * 9/2006 Grueneberg ..... A47F 5/11 211/94.01
2007/0235396 A1 * 10/2007 Moss ..... A47F 5/116 211/72
2008/0030113 A1 * 2/2008 Vail ..... A47B 43/02 108/165
2008/0067301 A1 * 3/2008 Moss ..... A47F 5/112 248/174
2008/0083682 A1 * 4/2008 Moss ..... A47F 5/116 211/72
2008/0169340 A1 * 7/2008 Sheffer ..... A47F 5/116 229/120.32
2009/0140118 A1 6/2009 Moss et al.
2010/0236117 A1 * 9/2010 Mestres Armengol ..... G09F 1/065 40/610
2012/0012734 A1 * 1/2012 Tzuo ..... G09F 1/065 248/689
2013/0213915 A1 * 8/2013 Pfeifer ..... A47F 5/116 211/195
2018/0235381 A1 * 8/2018 Frost ..... A47F 7/145
2019/0343301 A1 11/2019 Frost
2020/0383497 A1 * 12/2020 McGill ..... A47F 7/146
2023/0276957 A1 9/2023 Mcgill

OTHER PUBLICATIONS

"Final Office Action Received For U.S. Appl. No. 15/956,575 mailed on Jan. 4, 2019, 10 Pages."
"Final Office Action received for U.S. Appl. No. 14/146,130 dated Apr. 30, 2015, 11 pages".
"Final Office Action received for U.S. Appl. No. 14/968,352 dated Jul. 29, 2016, 14 page".
"Final Office Action received for U.S. Appl. No. 15/363,256 dated Jul. 3, 2017, 17 pages".

(56) References Cited

OTHER PUBLICATIONS

"Final Office Action received for U.S. Appl. No. 16/520,270, Mailed on Apr. 21, 2020, 14 Pages".
"Non- Final Action received for U.S. Appl. No. 16/896,503, Mailed on Jul. 21, 2021".
"Non Final Office Action received for U.S. Appl. No. 15/956,575, mailed on May 31, 2018, 10 pages".
"Non Final Office Action Received For U.S. Appl. No. 16/520,270, mailed on Aug. 22, 2019, 28 Pages."
"Non-Final Office Action Received for U.S. Appl. No. 16/896,503, mailed on Feb. 17, 2022."
"Non-Final Office Action received for U.S. Appl. No. 14/146,130 dated Sep. 2, 2014, 8 pages".
"Non-Final Office Action received for U.S. Appl. No. 14/968,352 dated Jan. 11, 2016, 13 pages".
"Non-Final Office Action received for U.S. Appl. No. 15/363,256 dated Dec. 16, 2016, 15 pages".
"Non-Final Office Action received for U.S. Appl. No. 18/114,579, Mailed on Dec. 29, 2023".
"Notice of Allowance Received for U.S. Appl. No. 15/363,256 mailed on Nov. 30, 2017".
"Notice of Allowance received for U.S. Appl. No. 14/146,130 dated Aug. 10, 2015, 14 pages".
"Notice of Allowance received for U.S. Appl. No. 14/968,352 dated Nov. 15, 2016, 33 pages".
"Notice of Allowance Received for U.S. Appl. No. 15/956,575, mailed on Apr. 17, 2019, 5 pages".
"Notice of Allowance Received for U.S. Appl. No. 14/968,352 on Nov. 15, 2016".
"Notice of Allowance Received for U.S. Appl. No. 16/896,503, mailed on Oct. 25, 2022".
"Notice of Allowance received for U.S. Appl. No. 18/114,579, Mailed on Apr. 23, 2024".
"Restriction Requirement Received for U.S. Appl. No. 16/896,503, mailed on Feb. 10, 2021."
"Restriction Requirement Received for U.S. Appl. No. 18/114,579, mailed on Jul. 28, 2023".

* cited by examiner

DIVIDED SHELF FOR MODULAR GREETING CARD RACK

PRIORITY CLAIM

The instant application is a divisional application of U.S. patent application Ser. No. 18/114,579 (now U.S. Pat. No. 12,075,928), filed Feb. 27, 2023, which is a continuation application of U.S. patent application Ser. No. 16/896,503, filed Jun. 9, 2020 (now U.S. Pat. No. 11,589,689), which claims priority to U.S. Provisional Patent Application No. 62/859,570, filed Jun. 10, 2019, the entire disclosures of which are incorporated by reference herein.

FIELD

Embodiments of the present invention relate generally to the field of point of purchase merchandise displays. More particularly, embodiments of the present invention relate to a corrugated, paperboard display that is manufactured in a fold and/or glue assembly process and that is traditionally provided to an end user in a collapsed or knockdown configuration for setup. More specifically, embodiments of the present invention relate to a particular shelf for a corrugated, paperboard display.

RELATED APPLICATIONS

Some examples of corrugated, paperboard displays with which the present invention may be used are disclosed in U.S. patent application Ser. No. 15/956,575, filed Apr. 18, 2018, now U.S. Patent Publication No. 2018/0235381, which is a continuation application of U.S. patent application Ser. No. 15/363,256, filed Nov. 29, 2016, now U.S. Pat. No. 9,986,856, which is a continuation application of U.S. patent application Ser. No. 14/968,352, filed Dec. 14, 2015, now U.S. Pat. No. 9,578,978, which is a continuation application of U.S. patent application Ser. No. 14/146,130, filed Jan. 2, 2014, now U.S. Pat. No. 9,212,019, which claims priority benefit, with regard to all common subject matter, of earlier-filed U.S. Provisional Patent Application No. 61/748,672, filed Jan. 3, 2013, and entitled "MODULAR GREETING CARD RACK," each of which are hereby incorporated by reference in their entirety into the present provisional application.

BACKGROUND

Corrugated displays and containers are often made from pieces of flat paperboard stock material that are die cut into shapes that define various panels. The shapes are folded along predefined lines (i.e., fold lines) between the panels with at least one overlapping strip or panel that is glued, taped or otherwise affixed to another panel to form an enclosed boundary. The panels are folded and/or glued into place to become the walls of the display or container. The displays or containers are traditionally provided to product manufacturers and/or retailers in a collapsed or knock-down configuration for storage, handling and shipping. The manufacturer and/or retailers open the knockdown containers and fold appropriately to utilize the assembled display or container for display and/or packing products therein.

The knockdown displays or containers are typically manufactured by feeding flat die cut sheets through a fold-and-glue machine. The fold-and-glue machine applies adhesive and folds over select panels so that the panels are in the knockdown configuration. One common knockdown display is a multi-shelved greeting card rack style display. A corrugated card rack display is typically used to display products, such as greeting cards, to consumers at a point-of-sale location. It is desirable to minimize the time and effort necessary to manufacture the card rack display and to erect the display from its knockdown configuration. Conventional, corrugated card rack displays often include shelves made using a single sheet of corrugated that "accordions" to make multiple shelves. This adds considerably to assembly labor and time as well as to material and labor costs for manufacturing the container. Thus, it would be beneficial to provide a card rack style display that reduces labor and material costs.

SUMMARY

Embodiments of the present invention include a shelf for use with a rack display. The divided shelf includes at least one divided shelf member with horizontal and vertical tabs. The shelf member also includes one or more dividers such that when erected the divided shelf member provides more than one compartment separated by the divider(s). The divided shelf member is secured to a rack display base by inserting the vertical and horizontal tabs within vertical and horizontal slots on the display rack base.

Embodiments of the present invention also include a method of making a divided shelf member for a display rack, which includes the steps of: forming a rack display base that includes horizontal and vertical slots; and forming one or more divided shelf members that are capable of being secured to the front panel of the base, with each of the divided shelf members including horizontal and vertical tabs and each of the shelf members including dividers that separate more than one shelf compartment. In such a method, the horizontal tabs are configured to be inserted within the horizontal slots and the vertical tabs are configured to be inserted within the vertical slots.

Embodiments of the present invention additionally include a method of erecting a divided shelf member for a rack display, which includes the initial step of providing the divided shelf in a knockdown configuration. The divided shelf member includes one or more shelf members, with the shelf members having one or more horizontal tabs and one or more vertical tabs. The shelf members also include dividers that separate more than one compartment of the shelf when the shelf is erected. The method additionally includes the steps of: folding the divided shelf members from the knockdown configuration to expand the dividers creating more than one separate compartments on each divided shelf member; and inserting the horizontal tabs of the divided shelf members within horizontal slots of a front panel of a display rack base; and inserting the vertical tabs of the divided shelf member(s) within vertical slots of a front panel of a display rack base.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of embodiments and the accompanying drawing figures.

BRIEF DESCRIPTION OF THE DRAWING FIGURES

Embodiments of the present invention are described below with reference to the attached drawing figures, wherein:

FIG. 1 is a plan view of a divided shelf member according to embodiments of the present invention;

FIG. 1*a* is an exploded view of a section of the divided shelf member of FIG. 1;

FIG. 1*b* is an exploded view of another section of the divided shelf member of FIG. 1;

Figure 1:
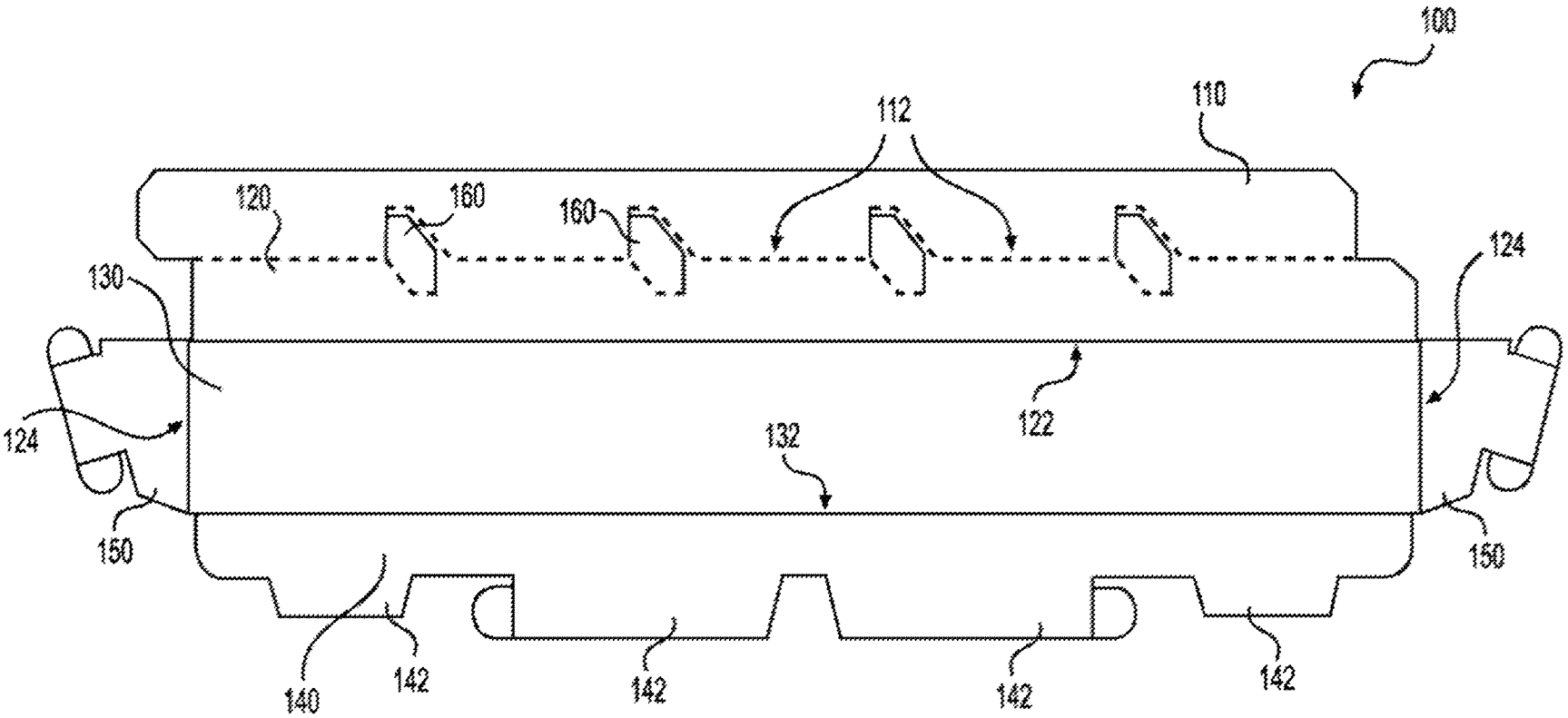

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

As used herein, direction or relational terms such as "front," "back," "left," "right," "top," and "bottom" are used as an aid to the reader in place of less visual terms such as "first" and "second." Such terms are used in the context of a user viewing embodiments of the present invention from a front view. Similarly, the term "longitudinal" generally refers to an orientation or direction relative to an axis of elongation, whereas "lateral" refers to an orientation or direction that is generally perpendicular to the axis of elongation.

Figure 2:
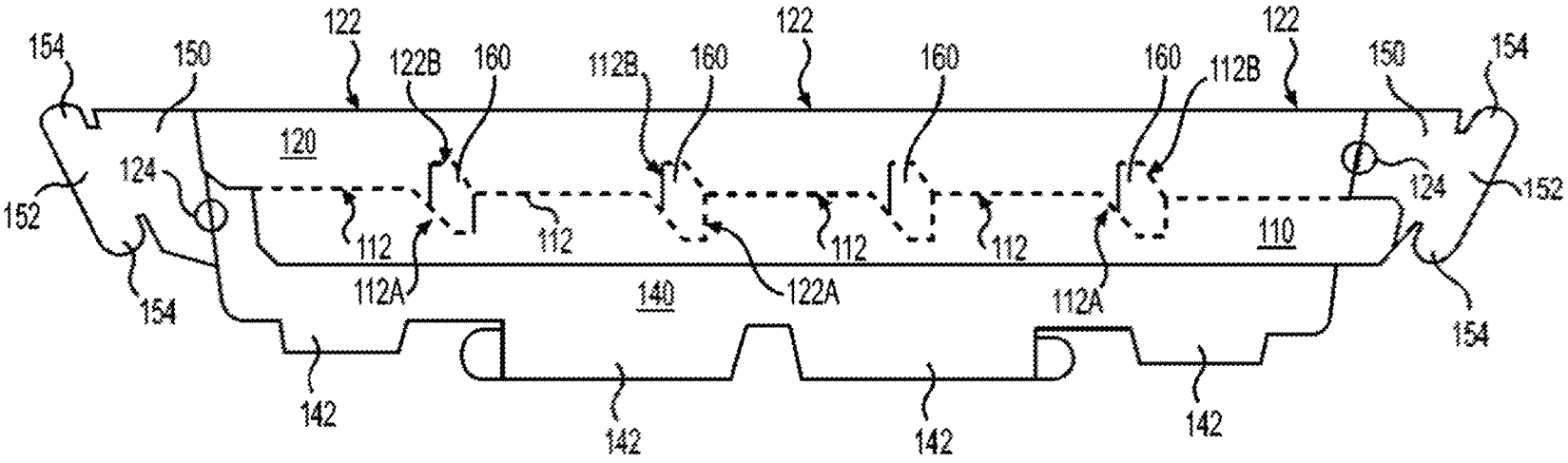
FIG. 2 is a plan view of the divided shelf member from FIG. 1, with the shelf member in the knockdown configuration.
Figure 3:
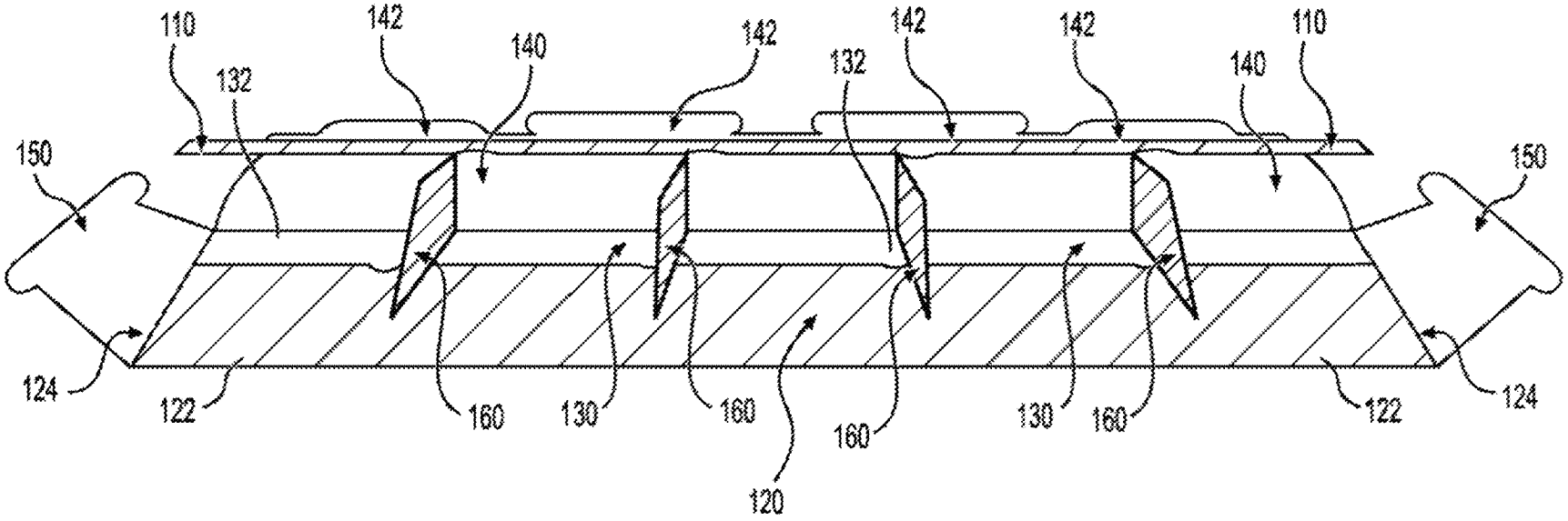
FIG. 3 is a top partial perspective view of the divided shelf member from FIG. 1, with the shelf member completely folded in the erected configuration.
Figure 4:
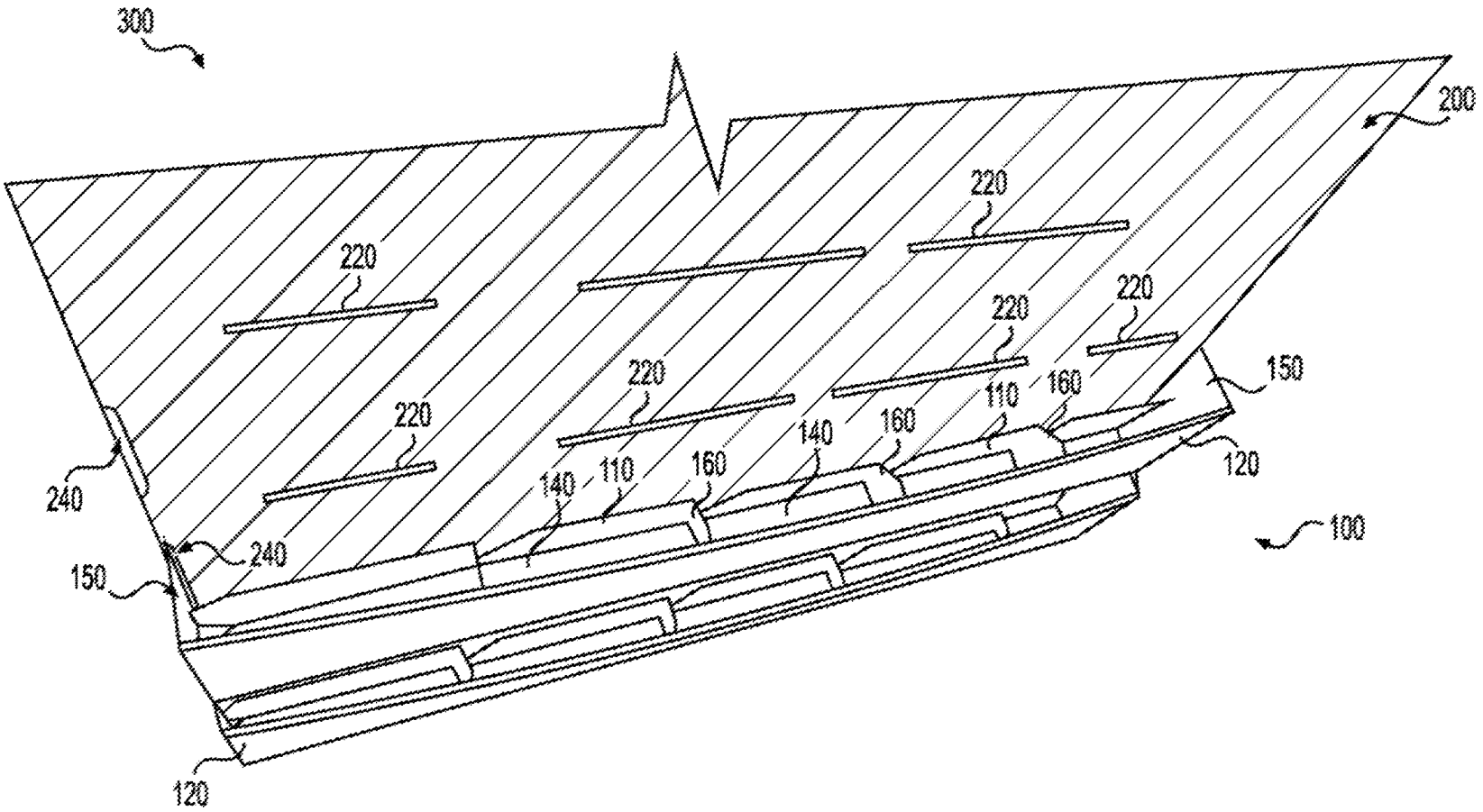
FIG. 4 is a perspective view of the divided shelf member from FIG. 1 in the erected configuration and secured to a rack display base.

As shown in FIG. 4, embodiments of the present invention include a divided shelf member 100 for accommodating and displaying products such as, for instance, cards, magazines, books, or the like. In certain embodiments, the divided shelf member is formed from corrugated material, such as paperboard. However, other embodiments provide for the corrugated material to include other similar type materials, such as cardboard, fiberboard, or the like. The divided shelf is operable to be provided in a knockdown configuration (i.e., a generally flat, two-dimensional form), such as illustrated in FIGS. 1-2. From the knockdown configuration, the divided shelf is operable to be transformed into an erected configuration, such as shown in FIGS. 3-4.

Referring to FIG. 1, an embodiment of the present invention is shown. The divided shelf member 100 includes an outer panel 130 separated by a fold line 122 from an inner panel 110/120. The outer panel includes side panels 150 that extend from sides of the outer panel and that are separated from the outer panel via side panel fold lines 124. In certain embodiments, the side panels 150 include vertical tabs 152 with tab fingers that extend from sides of the side tabs and that are capable of folding about the tabs via vertical tab finger fold lines 156. The vertical tab fingers 154 are used to provide additional support and securement for the divided shelf members 100 as they are attached to a display rack base 200. In certain embodiments, the shelf members additionally include a tab panel 140 that extends from the outer panel 130 and that is separated from the outer panel via an outer panel fold line 132. As will be described in further detail below, the tab panel 140 operates as the shelf floor or bottom when in the erected configuration. In some embodiments, the tab panel has one or more horizontal tabs 142 extending therefrom. In certain embodiments, the tab panel has one, two, three, four, five or more tabs extending therefrom. However, other embodiments provide for the tab panel to have more or less than three tabs. In certain embodiments of the present invention, the number of horizontal tabs of the tab panel corresponds to the number of horizontal slots 220 on a row of horizontal slots on a display rack base 200 (see FIG. 4). In even further embodiments, one or more of the horizontal tabs of the tab panel include horizontal tab fingers 144 that extend from sides of the horizontal tabs and are capable of folding with respect to the horizontal tabs along horizontal tab finger fold lines 146.

Figure 1A:
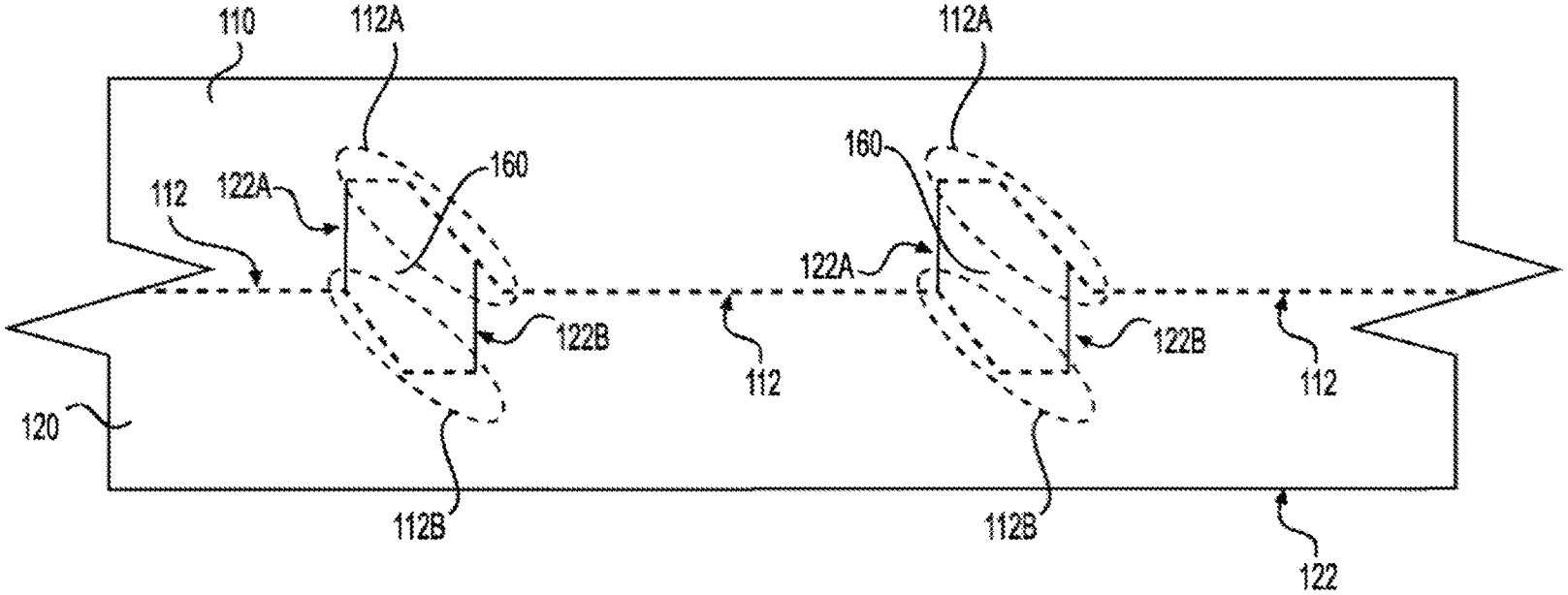
Figure 1B:
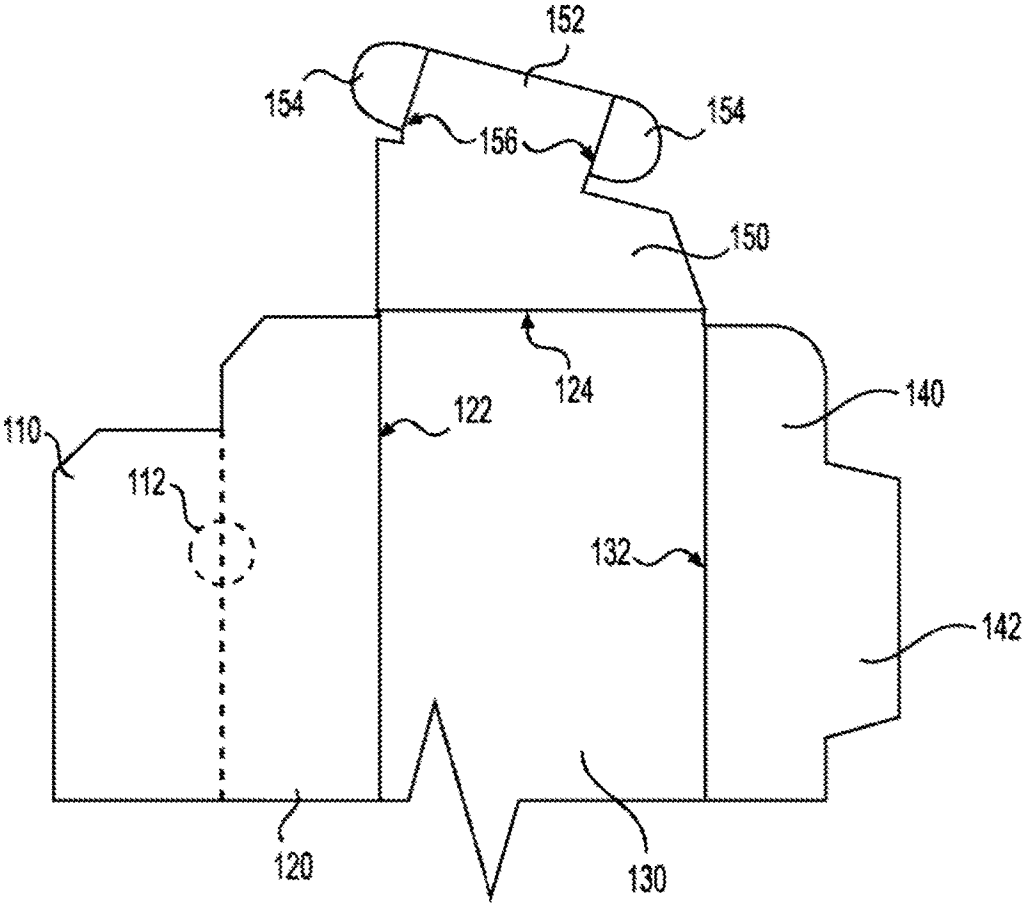

Still referring to FIG. 1, the inner panel includes a proximal inner panel 120, one or more divider panels 160, and a distal panel 110. The proximal and distal inner panels are proximal and distal with respect to the outer panel 130. In other words, the proximal inner panel is separated by an inner panel fold line 122 from the outer panel 130 and the distal inner panel 110 is farther away from the outer panel than the proximal inner panel 120. Referring also to FIG. 1*a*, the proximal inner panel 120 is separated from each of the one or more divider panels 160 by a proximal divider fold line 122B. The distal inner panel 110 is separated from each of the one or more divider panels 160 by a distal divider fold line 122A. The distal inner panel is separated from the proximal inner panel by the one or more divider panels and inner panel cut line 112. The distal edge of each divider panel 160 is separated from the distal inner panel 110 by a distal divider cut line 112A that is continuous with the inner panel cut line 112. The proximal edge of each divider panel 160 is separated from the proximal inner panel 120 by a proximal divider cut line 112B that is continuous with the inner panel cut line 112. In some embodiments, a strip of adhesive glue is applied to the proximal inner panel. In other embodiments, a strip of adhesive glue is applied to the outer panel 130 near the inner panel fold line 122 separating the outer panel and the proximal inner panel.

Referring to FIG. 2, the divided shelf is folded along the inner panel fold line 122 separating the outer panel 130 and the proximal inner panel 120. The proximal inner panel is glued to the outer panel. Neither the divider panels 160 nor the distal inner panel 110 are glued to the outer panel 130. The divided shelf member shown in FIG. 1 is a first knockdown configuration. The divided shelf member shown in FIG. 2 is a second or alternate knockdown configuration.

In operation, and with reference to FIG. 3, the divided shelf is capable of being transformed in a simple and quick manner from the knockdown configuration of FIGS. 1-2 to the erected configuration illustrated in FIGS. 3-4. To begin, if the divided shelf is in the first knockdown configuration as shown in FIG. 1, the inner panel 110/120 is folded about the inner panel fold line 122 separating the proximal inner panel 120 and the outer panel 130 such that the divided shelf member is then in the second or alternate knockdown configuration as shown in FIG. 2. The inner panel and outer panel are secured together by glue or other adhesive. In some embodiments, the outer and inner panels are glued together during manufacture and before shipping to the end user. In other embodiments, the outer and inner panels are glued together during erection of the divided shelf. When the divided shelf member is in the second or alternate knockdown configuration as shown in FIG. 2, the distal inner panel 110 is folded away from the proximal inner panel 120 by folding along each of the proximal divider fold lines 122B separating the proximal inner panel 120 and divider panels 160 and also folding along each of the distal divider fold lines 122A separating the divider panels and the distal inner panel 110, as shown in FIG. 3. When folding the distal inner panel 110 away from the proximal inner panel 120, they both remain generally parallel to one another. The divider panels 160 are generally parallel to the inner panel 110/120 when the divided shelf member is in the knockdown configuration, as shown in FIGS. 1-2, and the divider panels are generally orthogonal to the inner panel when the division shelf member is in the erected configuration, as shown in FIGS. 3-4. As shown in FIG. 4, the divider panels separate the divided shelf member into more than one separate compartments for displaying product.

Next, the side panels 150 are folded about the side panel fold lines 124 separating each side panel from the outer panel 130, until the side panels are generally perpendicular with the outer panel and the inner panel. Here, the outer panel is glued to the proximal inner panel. Similarly, the tab panel 140 is folded about the outer panel fold line 132 separating the tab panel 140 from the outer panel 130, until the tab panel is generally perpendicular with the outer panel, the inner panel, and the divider panels. Finally, the vertical tab fingers 154 on the vertical tabs 152 and the horizontal tab fingers 144 of the horizontal tabs 142 are folded at the vertical tab finger fold line 156 and horizontal tab finger fold line 146, respectively, against the respective tabs. In such an erected position, the divided shelf members 100 are configured for insertion and/or securement to the display rack base 200 of a display rack 300.

Turning to FIG. 4, with the divided shelf members 100 secured to a display rack base 200, the display rack 300 is in an erected configuration. As such the rack display with one or more divided shelf is capable of being utilized to hold and display various products, such as cards, magazines, books, or the like, which each shelf being divided into more than one separate compartments. To transform the divided shelf member from its erected configuration to its knockdown configuration, a user performs the steps described above in reverse order.

Although the invention has been described with reference to the embodiments illustrated in the attached drawing figures, it is noted that equivalents may be employed, and substitutions made herein without departing from the scope of the invention as recited in the claims.

The invention claimed is:

1. A method of erecting a divided shelf comprising the steps of:

providing a divided shelf in a knockdown configuration, the divided shelf comprising an outer panel; an inner panel comprising a distal inner panel, a proximal inner panel, and a series of divider panels, wherein the proximal inner panel is connected to the outer panel; first and second side panels connected to opposed ends of the outer panel, a tab panel connected to the outer panel and comprising one or more horizontal tabs extending from an outer edge of the tab panel, and a vertical tab extending from an outer edge of each side panel;

folding said vertical tabs to a folded configuration and inserting said vertical tabs into respective vertical slots of a display rack base;

inserting said one or more horizontal tabs within respective one or more horizontal slots of said display rack base; and folding said distal inner panel away from said proximal inner panel to form separate divided compartments.

2. The method of claim 1, further comprising the step of folding said inner panel over onto said outer panel.

3. The method of claim 2, further comprising the step of gluing said inner panel to said outer panel.

4. The method of claim 1, further comprising the step of die cutting a piece of corrugated cardboard.

5. The method of claim 1 further comprising the step of attaching multiple additional divided shelf members to said display rack base.

6. The method of claim 1, wherein:

each said vertical tab comprises one or two vertical tab fingers;

the divided shelf further comprises one or two horizontal tab fingers on one or more of said one or more horizontal tabs;

said step of inserting said vertical tabs into respective vertical slots of said display rack base comprises folding each of said vertical tab fingers, inserting each of said vertical tabs into one of said vertical slots, and then unfolding each of said vertical tab fingers; and said step of inserting said one or more horizontal tabs within respective one or more horizontal slots of said display rack base comprises folding each of said horizontal tab fingers, inserting each of said horizontal tabs into one of said horizontal slots, and then unfolding each of said horizontal tab fingers.

* * * * *